United States Patent [19]

Pohl

[11] Patent Number: 4,860,778

[45] Date of Patent: Aug. 29, 1989

[54] CONTAMINANT SHIELD AND METHOD OF CONSTRUCTING SAME

[75] Inventor: Ronald R. Pohl, Rochester, Mich.

[73] Assignee: Venderbush Industrial Corporation, Mt. Clemens, Mich.

[21] Appl. No.: 164,220

[22] Filed: Mar. 4, 1988

[51] Int. Cl.[4] ..... E04H 15/34

[52] U.S. Cl. ..... 135/97; 135/101; 52/63

[58] Field of Search ..... 135/101, 97; 52/202, 52/222, 63, 81; 47/17

[56] References Cited

U.S. PATENT DOCUMENTS

| | | | |
|---|---|---|---|
| 2,711,181 | 6/1955 | Woods | 135/97 X |
| 2,757,677 | 8/1956 | Denn . | |
| 2,828,757 | 4/1958 | Thaxton | 135/97 |
| 2,905,281 | 9/1959 | Zitomer | 135/101 X |
| 3,004,542 | 10/1961 | Moody | 135/97 |
| 3,343,324 | 9/1967 | Gordon | 52/81 X |
| 3,375,831 | 4/1968 | Serbus | 135/101 |
| 3,424,178 | 1/1969 | Yazaki | 135/106 |
| 3,660,952 | 5/1972 | Wilson | 52/81 |
| 3,788,335 | 1/1974 | Hemmelsbach . | |
| 3,909,994 | 10/1975 | Richter | 52/63 |
| 4,091,584 | 5/1978 | Brown . | |
| 4,121,604 | 10/1978 | Rain . | |
| 4,146,997 | 4/1979 | Diethorn | 52/81 |
| 4,189,880 | 2/1980 | Ballin | 52/222 X |
| 4,231,289 | 11/1980 | Domicent . | |
| 4,261,144 | 4/1981 | Rizzo | 52/63 |
| 4,274,234 | 6/1981 | Abell . | |
| 4,347,690 | 9/1982 | Wallace, Jr. . | |
| 4,381,140 | 4/1983 | Abbott | 52/222 X |
| 4,381,629 | 5/1983 | Ahn . | |
| 4,404,980 | 9/1983 | Wade . | |
| 4,453,585 | 6/1984 | Ruggeberg, Sr. et al. | 52/222 X |
| 4,566,236 | 1/1986 | Pound | 52/202 X |
| 4,649,947 | 3/1987 | Tury et al. | 135/97 |
| 4,665,670 | 5/1987 | Van der Burg | 52/202 X |
| 4,696,132 | 9/1987 | LeBlanc | 52/71 X |
| 4,769,962 | 9/1988 | Pohl et al. | 135/101 X |

FOREIGN PATENT DOCUMENTS

| | | | |
|---|---|---|---|
| 1338345 | 8/1963 | France | 135/106 |
| 2400607 | 4/1979 | France | 52/202 |
| 1176643 | 1/1970 | United Kingdom | 52/222 |

*Primary Examiner*—David A. Scherbel
*Assistant Examiner*—Lan Mai
*Attorney, Agent, or Firm*—Basile and Hanlon

[57] ABSTRACT

A contaminant shield prevents airborne contaminants from contacting manufactured parts in a work area in a manufacturing facility. The contaminant shield is formed of a plurality of like frames, each formed of a plurality of interconnected side frame members covered by a flexible sheet attached at its outer edges to the side frame members. The frames are interconnected at adjacent edges to form the complete contaminant shield. A sealing strip is applied to the joints between adjacent frames to form a continuous contaminant barrier in conjunction with the flexible sheet attached to each frame. The contaminant shield is constructed by first constructing a plurality of frames by interconnecting side frame members into a rigid, planar frame and attaching the edges of a flexible sheet to each side frame member of the frame. Each of the side frame members includes an aperture which receives a complimentrally shaped cap which traps the edges of the flexible sheet between itself and the aperture in the side frame for securely attaching the flexible sheet to the side frame.

11 Claims, 3 Drawing Sheets

CONTAMINANT SHIELD AND METHOD OF CONSTRUCTING SAME

BACKGROUND OF THE INVENTION

1. Field of the Invention

The present invention relates to building structures.

2. Description of the Prior Art

In manufacturing facilities, it is commonplace to protect parts and assemblies during manufacturing from airborne contaminants, such as dust, particles, water, etc., so as to prevent such contaminants from contacting the parts during assembly or during idle downtime. This is particularly important in painting, spraying and coating operations which require extreme cleanliness of the prepared surface before painting, etc., and protection of the painted surface until the paint has completely dried.

To accomplish this, it is common to surround painting and spraying areas in a manufacturing facility with an enclosure to retain airborne paint particles within the enclosure and to prevent other contaminants from contacting the part surfaces. Such enclosures typically incorporate a skeletal framework of spaced, interconnected members to which a number of frame panels, typically rigid members made of steel or other material, are mounted.

While the use of such a building structure is effective at containing the airborne particles within a given area or protecting parts from airborne contaminants, the cost of such a rigid panel enclosure is high especially since long distances must be covered and considerable installation time is required to install the framework in the manufacturing facility and to attach the rigid panels thereto. The high cost of previously devised enclosures has prevented their use over large portions of conveyor lines in manufacturing plants and, thus, the parts are left unprotected after painting, spraying, coating, etc., and between initial surface preparation and painting etc., and are vulnerable to dust, water and other airborne contaminants.

Building structures have also been designed for other applications, such as greenhouses, tents, etc., which use a single, flexible sheet or cover which is placed over and attached to a skelatal framework. This building structure also forms an effective containment shield or barrier surrounding a given area. However, it has been found that it is difficult and time consuming to install a large, single piece cover to a large skeletal framework. This increases installation time and adds to overall manufacturing costs.

Thus, it would be desirable to provide a containment shield which can be installed at the use site in a minimum amount of time. It would also be desirable to provide a contaminant shield which has reduced manufacturing costs. It would also be desirable to provide a contaminant shield which does not require a skeletal framework to be installed at the use site for attachment of rigid frame panels thereto. Finally, it would be desirable to provide a contaminant shield which can be constructed in any configuration for widespread use in many different applications.

SUMMARY OF THE INVENTION

The present invention is a contaminant shield and method of constructing the same.

The contaminant shield of the present invention is formed of a plurality of identically constructed frames of the same or substantially the same configuration which are interconnected in a predetermined configuration to surround or cover a work area to prevent dust and other airborne contaminants or particles from contacting parts within the area. The frames are formed of a plurality of side frame members which are joined together into an integal, planar assembly having a predetermined shape. The side frame members surround an interior opening. A flexible sheet is attached to the side frame members covering the opening in the frame.

A plurality of such frames, having the same or different configuration are interconnected together to form a contaminant shield having any desired shape. For example, a plurality of frame members may be interconnected to form a three-sided floor-mounted enclosure having opposed side walls joined together by a top. Similarly, the frame members may be joined together to form an elongated planar cover having depending side walls which covers a work area in a manufacturing facility.

In one embodiment, means for attaching the edges of a flexible sheet to the side frame members of a frame are provided. Preferably, the attaching means comprises each side frame member having opposed side walls joined together at one end by an integral, central portion. The opposite ends of the side walls are each formed with an inwardly and downwardly extending flange, with the inner faces of the flanges being spaced apart to define an aperture opening into the hollow interior of each side frame member. A cap member has first and second end portions, with the first end portion being complimentary shaped to the configuration of the aperture in the side frame members. The second end portion of the cap member has an enlarged cross section with flanges extending outward from the first end portion. The first end portion of a cap member is slidably inserted into the aperture in a side frame member to trap an edge of the flexible sheet between first end portion and the side frame member to securely attach the flexible sheet to the side frame member. Cap members are inserted into the remaining side frame members of a frame to securely attach the sheet to the frame.

After the frames are constructed at the manufacturing facility, they are shipped to the use site and arranged to form a contaminant shield having a predetermined configuration. After the frames are joined together as described above to form an enclosure, shield, cover, etc., the joints between adjacent side frame members of adjacent frames are sealed by a tape, for example, to provide a continuous, protrusion free surface in conjunction with the flexible sheet which provides no dust collection surfaces within or under the contaminant shield and effectively blocks the interior space enclosed or covered by the contaminant shield from airborne contaminants, such as particles, dust, water, etc.

In a preferred embodiment, each of the side frame members has opposed side walls interconnected by a central portion. In attaching the flexible sheet to the frame according to the method of the present invention, the flexible sheet is first loosely placed over one entire side of the frame covering all of the side frame members. Tension is applied to one edge of the flexible sheet while the cap member is slidably inserted into one of the side frame members trapping the edge of the flexible sheet between itself and the side frame member. In a preferred embodiment, tensioning means in the form of an elongated rod is placed over the flexible sheet drawing one edge of the sheet into the hollow interior of the side frame member. This applies tension to the sheet while the cap is inserted into that particular side frame member. Similar steps are performed with the remaining side frame members of the frame until the cap members have been emplaced within each side frame member to securely attach all of the edges of the flexible sheet to the frame.

The contaminant shield of the present invention provides many unique advantages in constructing contaminant shields or barriers for manufacturing facilties since it minimizes installation time and has a reduced manufacturing cost. By constructing the individual frames at the frame manufacturing site, the need for constructing and installing a skeletal frame at the use site is eliminated. This reduces installation time. Also, the advantages of mass production of identical or nearly identical frames is attained thereby reducing the overall manufacturing cost of the contaminant shield. Since the contaminant shield of the present invention finds advantageous use with conveyor lines or other elongated work areas, the contaminant shield will contain a large number of identical frames thereby enabling the economies of mass production of the identical modular frames at the frame manufacturing site to be realized.

The contaminant shield of the present invention, once installed at the use site, provides an effective barrier which prevents airborne contaminants, such as dust, particles, waterm etc., from contacting work parts or assemblies in a given area within a manufacturing facility.

BRIEF DESCRIPTION OF THE DRAWING

The various features, advantages and uses of the present invention will become more apparent by referring to the following detailed description and drawing in which.

DESCRIPTION OF THE PREFERRED EMBODIMENTS

Figure 1:
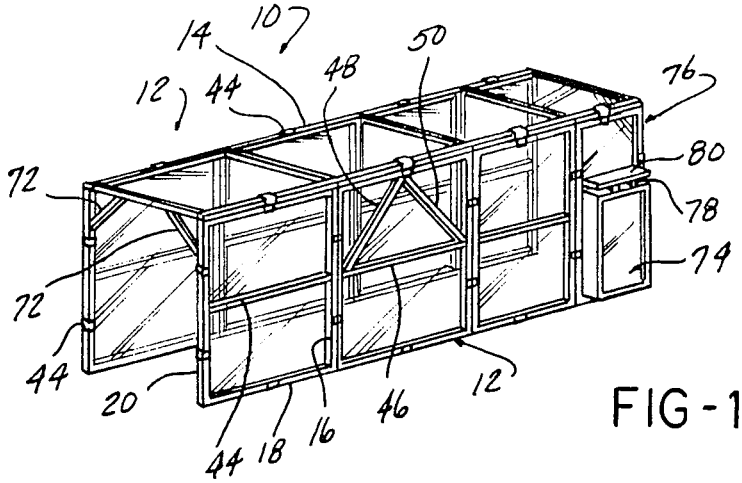
FIG. 1 is a perspective view of a contaminant shield constructed in accordance with the teachings of one embodiment of the present invention.

Throughout the following description and drawing, an identical reference number is used to refer to the same component shown in multiple figures of the drawing.

As shown in general in FIG. 1, the present invention is a contaminant shield 10 which protects manufacturing parts and assemblies in a predetermined area in a manufacturing facility from contact with airborne cotaminants, such as dust particles, etc., during the manufacturing process.

As shown in FIG. 1 and in greater detail in FIGS. 2–5, the contaminant shield 10 may be formed in any desired configuration having any predetermined length, width, height or shape depending upon the particular application to which it is applied. By way of example only, the contaminant shield 10 shown in FIG. 1 is in the form of a three-sided enclosure having opposed open ends through which parts pass.

The contaminant shield 10 is formed of a plurality of interconnected frames 12. The frames 12 may have any desired shape or configuration, such as square, rectangular, triangular, trapezoidal, etc., as required for a particular application. The frames 12 may also have any desired dimensions. For reasons of clarity, the following description will be provided for a general overall description of the construction and use of the frame 12 shown in FIG. 1. It will be understood that this is general in nature and is not intended to limited applicant's invention to the specific configuration shown in FIG. 1.

Figure 2:
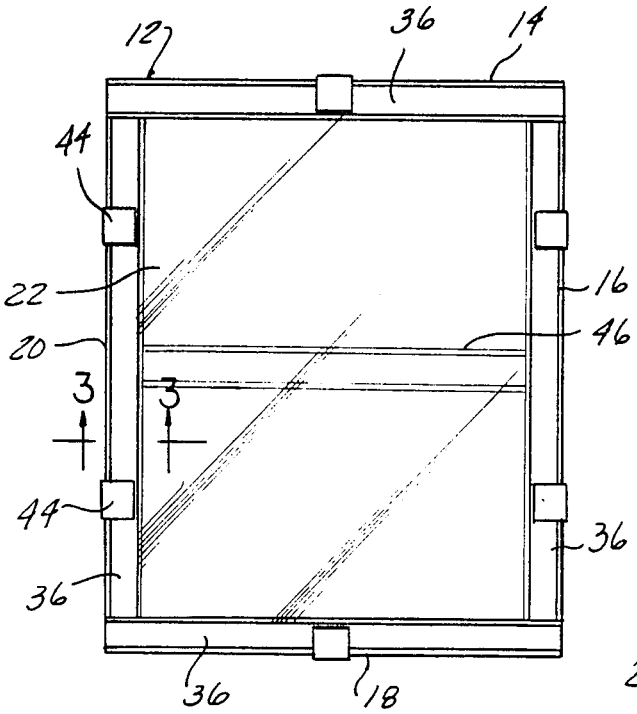
FIG. 2 is an elevational view of one of the frames employed in the contaminent shield shown in FIG. 1.
Figure 3:
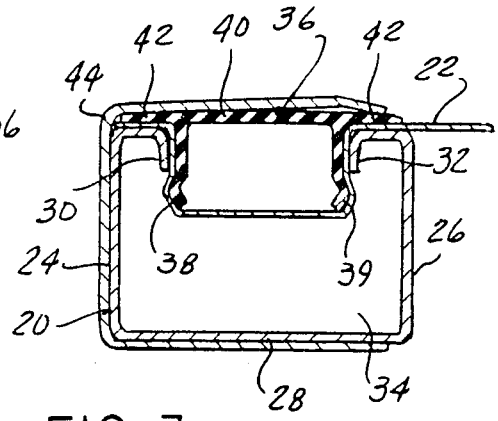
FIG. 3 is a cross sectional view generally taken along line 3—3 in FIG. 2.
Figure 4:
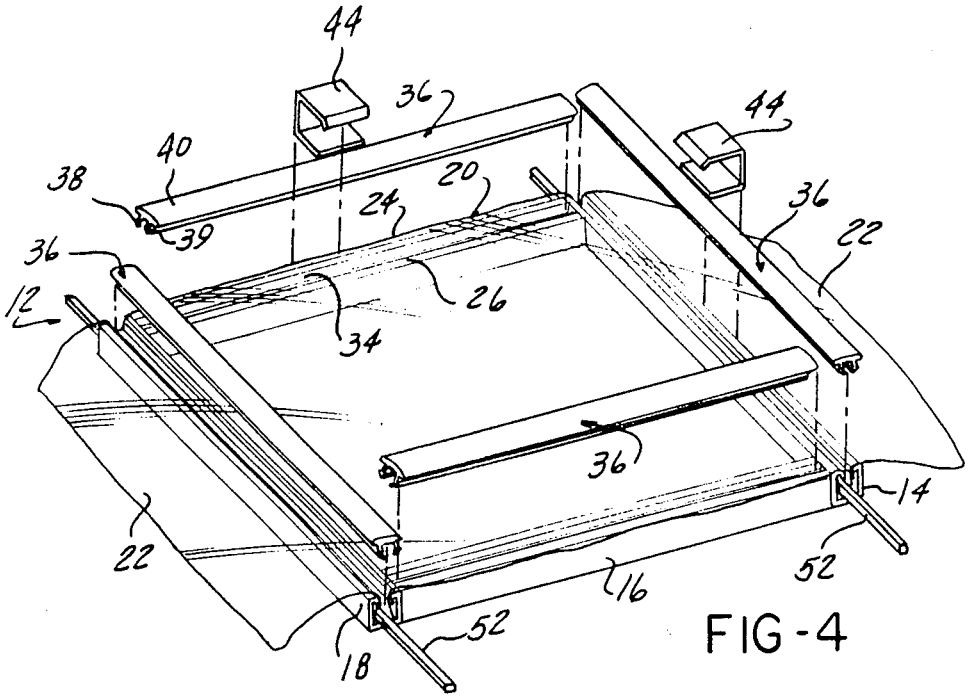
FIG. 4 is an exploded, perspective view showing the method steps employed in constructing the frame shown in FIG. 2.

As shown in FIGS. 2, 3 and 4, each frame 12 includes a plurality of side frame members 14, 16, 18 and 20 which are joined together at their ends and covered by a flexible sheet 22. The side frame members 14, 16, 18 and 20 are joined together, typically by welding, at their abutting ends as shown in FIG. 2. The side frame members thus form an opening between their innermost edges which is covered by the flexible sheet 22.

In a preferred embodiment, the flexible sheet 22 is attached to the frame 12 by attaching means. The attaching means includes each of the side frame members 14, 16, 18 and 20 being formed with opposed side walls 24 and 26, as shown in FIG. 3, which are interconnected at one end by a central bite portion 28. The opposed ends of the side walls 24 and 26 terminate in inwardly and downwardly extending flanges 30 and 32, respectively, which define an aperture 33 between their opposed, facing surfaces. The aperture 33 opens into the hollow interior 34 within the side frame member, such as side frame member 20 shown in FIG. 3.

The attaching means also includes a cap 36 which is removably insertable into the aperture 33 formed between the flanges 30 and 32 to trap and securely attach the edges of the flexible sheet 22 to the side frame member 20. As shown in detail in FIG. 3, the cap member 36 has a first end portion formed of spaced flanges 38 and 39 which are spaced apart so as to snugly engage the flanges 30 and 32 in the side frame member 20. The second end portion 40 of the cap 36 has an enlarged cross section with outwardly extending flanges 42 which overlie the edges bounding the aperture 33 to form a substantially smooth continuous surface with the flexible sheet 22.

As shown in FIGS. 2 and 4, a plurality of generally U-shaped clamps 44 are inserted over the top of the cap members 36 and adjoining side edges of the side frame member, to hold the cap member 36 in place in the side frame member. One end 45 of the clamp 44 is bent toward the opposed leg to enable it to securely engage and exert a downward pressure on the cap member 36. This is important in certain applications since the flexible sheet 22 has a tendency to shrink at elevated temperatures thereby placing tension on the cap members 36 which could cause inadvertent release of the cap member 36 from the side frame member.

Various reinforcing members may also be employed to increase the rigidity and structural strength of the frame 12. As shwon in FIGS. 1 and 2, a reinforcing strip 46 having a form substantially identical to that of the side frame members 14, 16, 18 and 20 is connected at opposed ends between two of the opposed side frame members, such as side frame members 16 and 20 as shown in FIG. 2. Further, additional reinforcement members 48 and 50 may be connected as shown in FIG. 1 between the reinforcing strip 46 and one of the side frame members, such as side frame member 14, for futher rigidity. It should be noted that the additional reinforcing members 48 and 50 need not be employed in each frame in the complete contaminant shield 10 but only at spaced locations along the length of the shield 10 where needed.

The flexible sheet 22 is preferably formed of a flexible material which has sufficient strength to resist tearing or ripping and yet provides a non air porous barrier which prevents the passage of airborne contaminants through the contaminant shield 10. Preferably, the flexible sheet 22 is formed of a flexible, plastic material which is clear or at least semi-transparent.

Referring now to FIG. 4, there is illustrated the sequential method steps employed in forming one of the frames 12 of the present invention. The first step in forming the frame 12 is to interconnect a plurality of side frame members, such as side frame members 14, 16, 18 and 20 in the example shown in FIG. 4, into a planar shape. A rectangular shape is illustrated in FIG. 4 by way of example only and includes four side frame members 14, 16, 18 and 20 which are joined together at their ends by any suitable means, such as by welding. Next, after the side frame members 14, 16, 18 and 20 have been joined together, the flexible sheet 22 is placed thereover and attached to the side frame members 14, 16, 18 and 20.

In a preferred embodiment, attaching means is employed which comprises the interfitting cap members 36 which are slidably insertable into the hollow interior 34 of each of the side frame members as described above. It is also preferred that tension be applied to the flexible sheet 22 as each cap member 36 is inserted into its associated side frame member. Accordingly, tensioning means 52 in the form of a heavy, elongated rod is utilized. The rod 52 is placed over one edge of the flexible sheet 22 drawing the one edge of the flexible sheet 22 into the hollow interior 34 of one side frame member, such as side frame member 14. This applies tension to one end of the flexible sheet 22 as the cap member 36 is inserted into the side frame member 14. The tensioning rod 52 is then be removed from the side frame member 14.

Another tensioning rod 52 is inserted over the flexible sheet 22 at the opposed end of the frame 12 drawing the opposite end of the flexible sheet 22 into the hollow interior 34 of the opposed side frame member 18 as shown in FIG. 4. This applies tension along one dimension of the flexible sheet 22 as the cap member 36 is inserted into the side frame member 18. The second tensioning rod 52 is then be removed from the side frame member 18.

The cap members 36 are then inserted into the remaining side frame members 16 and 20 as tension is applied to the edges of the flexible sheet 22 overlaying each side frame member 16 and 20. Such tension can be applied by manually pulling on the outer edge of the flexible sheet 22 as each cap member 36 is inserted into the side frame member 16 and 20.

Finally, the cap clamps 44 are attached over the caps 36 to provide secure retention of the caps 36 in the side frame members.

As noted above, advantageous use of the present invention may be attained by first constructing a plurality of frames 12 ad described above at a frame manufacturing facility and then shipping the frames 12 to the use site for interconnection into the completed contaminant shield 10. Since the contaminant shield 10 will usually incorporate a large number of identical frames 12, the advantages of large scale mass production may be realized since a large number of identical frames 12 may be constructed at one time at the manufacturing site.

Figure 5:
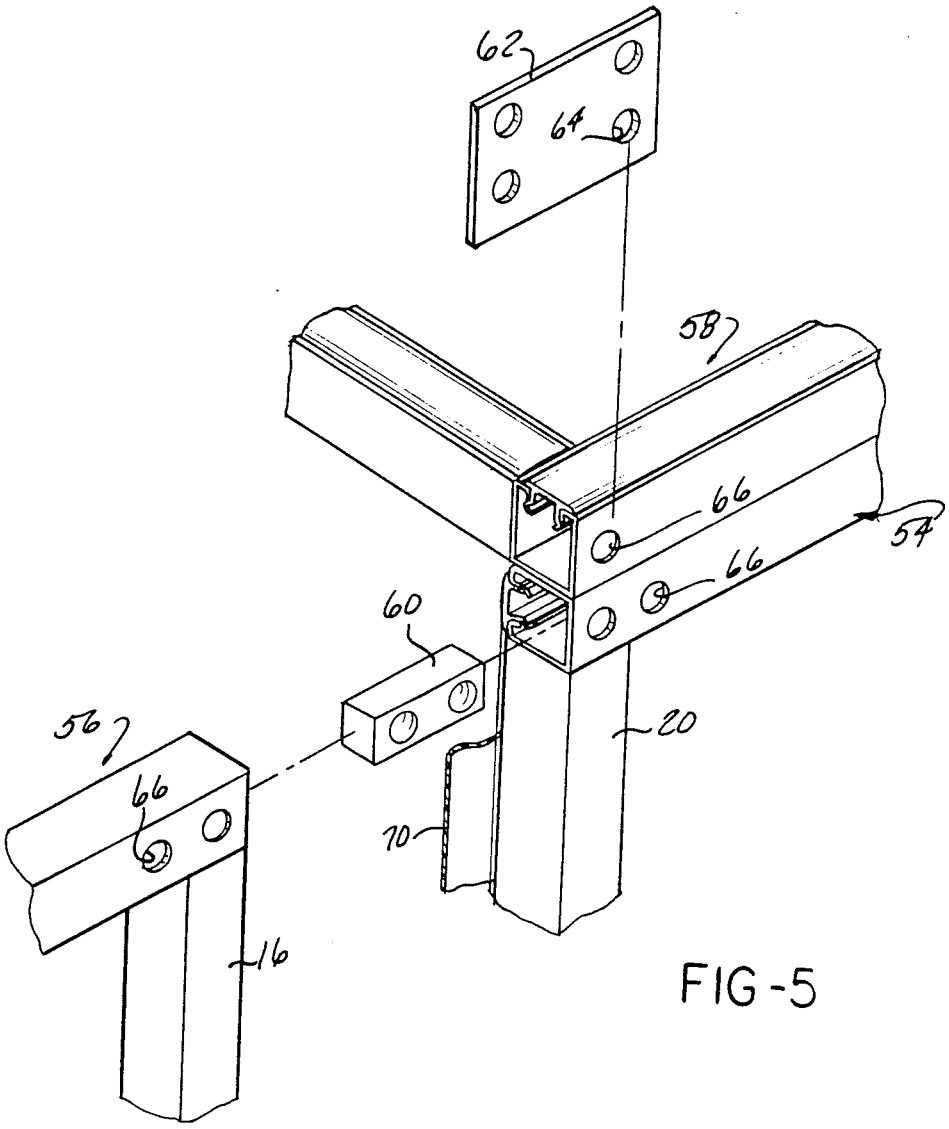
FIG. 5 is a partial, exploded, perspective view showing the interconnection of various frames into a complete contaminant shield.

The interconnection of the frames 12 into the complete contaminant shield 10 is illustrated in greater detail in FIG. 5 which depicts the interconnection of two adjacent, vertically oriented frames, denoted in general by reference numbers 54 and 56, with a top frame 58 to form the contaminant shield 10 shown in FIG. 1.

Each of the frames 54, 56 and 58 is substantially identically constructed as described above and shown in FIGS. 2, 3 and 4. The vertically oriented frames 54 and 56 may be attached to an underlying support surface, such as the floor or be free standing. The two vertically oriented frames 54 and 56 are abutted, side-by-side and may be optionally aligned by means of an interconnecting plug 60. The plug 60 has a cross section so as to enable it to slidably fit within the hollow interior of the uppermost side frame members forming the frames 54 and 56 as shown in FIG. 5. Apertures for receiving fasteners, not shown, are formed in the interconnecting plug 60 and the cental portions of the side frame members of the frames 54 and 56 to secure adjacent disposed frames 54 and 56 together.

Interconnection is also provided for attaching one or more top, horizontally oriented frames 58 to one or more vertically oriented frames 54 and 56. A planar connector 62 includes apertures 64 which are alignable with corresponding apertures 66 formed in the side frame members of the vertically oriented frames 54 and 56 to receive fasteners to securely attach the horizontal frame 58 to the vertical frames 54 and 56. Additional planar connectors, not shown, may also be employed along the vertical extent of the frams 54 and 56 to securely joint adjacent side frame members together into an integral unit.

In order to provide a contaminant free barrier as well as a shield having no dust or contaminant collection surfaces, it is preferred that the flexible sheet 22 be disposed on the inward side of the contaminant shield, as shown in FIG. 1, on the vertically oriented frames and on the inward or outward facing side of the horizontally oriented frames, such as frame 58. In this manner, any contaminants or particles which may enter the interior of the contaminant shield 10 will fall directly to the floor and will not adhere to the vertical or horizontal surfaces of the contaminant shield 10.

Sealing means is also employed to completely seal the joints between abutting side frame members of adjacent positioned frames. This is shown in FIG. 5 by means of a sealing strip or tape 70 which is placed over the joint between adjacent side frame members 16 and 20 of side frames 56 and 54, respectively. The sealing strip 70 may be placed on the side of the joint between the flexible sheets 22 on the side frames 56 and 54 or on the opposite side as desired. This provides a continuous barrier preventing the passage of contaminants through the contaminant shield 10.

As noted above, the contaminant shield 10 of the present invention may be formed in any desired configuration depending on the particular application to which it is applied. As shown in FIG. 1, additional reinforcements, such as angularly positioned bars 72 may be attached between vertically extending side frame members and horizontal side frame members of interconnected frames to provide structural rigidity for the overall contaminant shield 10.

Also, certain applications require a sloped or angled top cover for water drainage. This requirement can be achieved by merely forming certain side frame members, such as side frame members 16, 20 in the orientation shown in FIG. 1, with a longer length than the corresponding side frame members of opposed frames. This will cause the top positioned frame to be disposed at a downward extending angle from one side of the shield 10 to the other. Alternately, the top most frame can be formed in two or more angularly disposed sections which angle downward from a peak.

Further, a frame may be constructed having a slidable door, such as slidable door 74 mounted in frame 76 in FIG. 1. The door 74 and frame 76 are formed substantially identical to that described above with respect to frame 12 including the side frame members and overlying, attached flexible sheet 22. However, the door 74 is provided with its own frame and flexible sheet 22 and includes rollers 78 which slide within a track 80 mounted on the frame 76. The door 74 is sized to fit in approximately one-half of the width of the frame 76, with the remaining half having a flexible sheet and side frame assembly constructed identical to that described above for frame 12. The door 74 allows access to the interior of the contaminant shield 10 which may be desirable in certain applications where the length of the contaminant shield 10 is considerable. It should be noted that a plurality of doors 74 may be employed at spaced intervals along the length of the contaminant shield 10 where access is desired to the interior of the contaminant shield 10.

Figure 6:
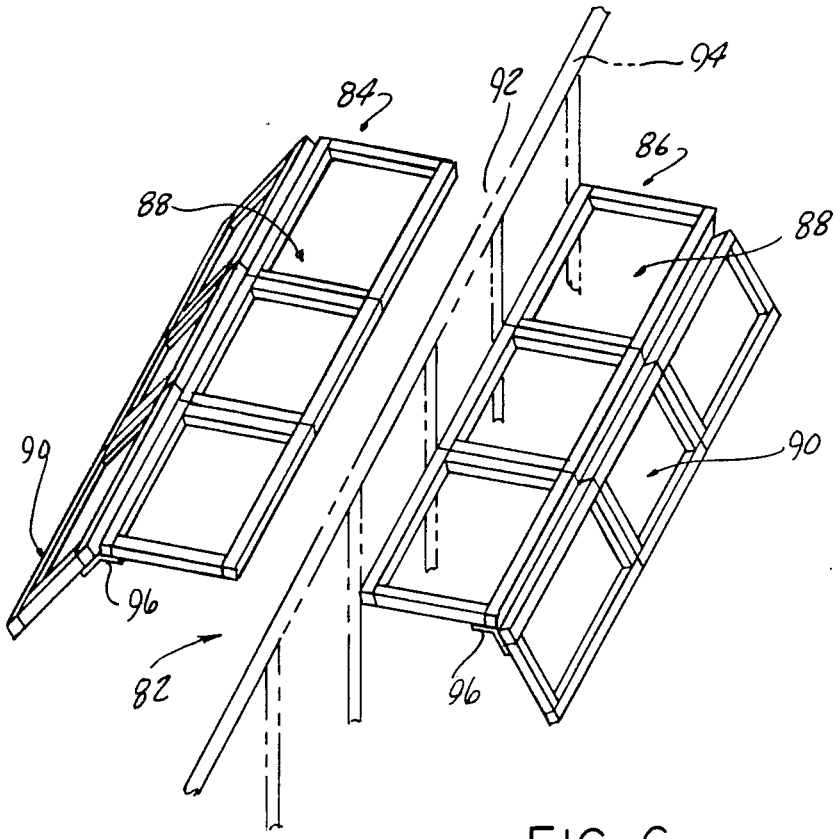
FIG. 6 is a perspective view of a contaminant shield constructed in accordance with the teachings of another embodiment of the present invention.

An alternate configuration for the contaminant shield of the present invention is shown in FIG. 6. In FIG. 6, the contaminant shield 82 is in the form of a cover overlying a work surface. The cover is not attached to the floor; but, rather, is attached to the overhead building support or frame work structure. The contaminant shield 82 is formed with two identical sections 84 and 86, each including a top, substantially horizontally oriented portion 88 and attached depending side walls 90. Both the top portion 88 and the depending side wall portions 90 are formed of a plurality of interconnected frames, formed identical to that described above with reference to frame 12.

It should be noted that the top portions 88 of the sections 84 and 86 are spaced apart leaving an opening 92 extending along the length of the contaminant shield 82 for passage of a conveyor 94 for conveying parts through the contaminant shield 82. The depending side wall portions 90 are interconnected and attached to one edge of the top sections 88 by means of angularly shaped connectors 96 which are attached to the side frame members of the top and side wall sections 88 and 90 by means of suitable fasteners, such as bolts, screws, etc. It should be noted that the side walls 90 may be disposed at any desired angle with respect to the top portion 88. Also, the top portions 88 may be disposed at a downward angle with respect to the horizontal to provide a sloped shape for the shield 82 for water drainage.

In summary, there has been disclosed a unique contaminant shield and method for constructing the same which prevents airborne contaminants, such as dust particles, water, etc., from contacting and accumulating on the surfaces of parts and assemblies in a manufacturing facility. The contaminant shield is formed of a plurality of identically constructed modular frames having a flexible sheet attached to each frame. The frames are interconnected at the manufacturing site to form the complete contaminent shield thereby reducing installlation time since a skeletal frame work is not required and the economies of mass production of large numbers of substantially identical frames may be realized at the frame manufacturing site.

What is claimed is:

1. A method of constructing a contaminent shield comprising the steps of:

joining a plurality of elongated, planar side frame members into a frame;

sealingly attaching a flexible sheet to the entire periphery of one side of the frame by:

placing the edges of the flexible sheet over the side frame members, each of the side frame members being formed with opposed side walls interconnected by a central portion, with inwardly and downwardly extending, spaced flanges formed on the opposite ends of the side walls forming an aperture opening into the hollow interior of the side frame members;

inserting a cap having a first end portion formed complimentary to the aperture in the side frame nenbers and a second enlarged portion having flanges in the side frame member into the aperture in the side frame member trapping the edger of the flexible sheet between the first end portion of the cap member and the side frame to securely attach the flexible sheet to the side frame; and repeating the insertion of a cap member into a side frame member for each of the remaining side members of the frame;

abutting certain side frame members of a plurality of frames into a predetermined configuration;

joining abutting side frame members together; and sealing substantially the entire length of the joint between abutting side frame members of a plurality of frames to form a continuous contaminant barrier in conjunction with the flexible sheet on each frame.

2. The method of claim 1 further including the step of:

tensioning the sheet as the cap member is inserted into a side frame member trapping the flexible sheet between the cap member and the side frame member.

3. A methof of constructing a contaminant shield comprising the steps of:

joining a plurality of elongated, planar side frame members into a frame;

sealingly attaching a flexible sheet to the entire periphery of one side of the frame including the steps of:

placing the edges of the flexible sheet over the side frame members, each of the side frame members being formed with opposed side walls interconnected by a central portion, with inwardly and downwardly extending, spaced flanges formed on the opposite ends of the side walls forming an aperture opening into the hollow interior of the side frame members;

inserting tensioning means overlaying one edge of the sheet into the interior of one of the side frame members to dispose one edge of the sheet in the interior of the one side frame member and to apply tension to the sheet;

inserting a cap having a first end portion formed complimentary to the aperture in the side frame members and a second enlarged portion having flanges extending outward from the first end portion to overlay the flanges in the side frame member into the aperture in the side frame member trapping the edge of the flexible sheet between the first end portions of the cap member and the side frame to securely attach the flexible sheet to the side frame;

repeating the insertion of a cap member into a side frame member for each of the remaining side members of the frame;

abutting certain side frame members of a plurality of frames into a predetermined configuration;

joining abutting side frame members together; and sealing the joint between abutting side frame members of a plurality of frames to form a continuous contaminant barrier in conjunction with the flexible sheet on each frame.

4. The method of claim 3 wherein tensioning means is next applied in an opposite one of the side frame members.

5. A contaminant shield comprising:

a plurality of like frames, each frame comprising:

a plurality of side frame members joined into a frame having a predetermined shape;

a flexible sheet; and means for sealingly attaching substantially the entire edge of the flexible sheet to the periphery of the frame; the attaching means comprising:

each of the side frame members being formed with spaced side walls interconnected at one end by a central portion and inwardly and downwardly extending flanges formed at the opposite end of each side wall having spaced opposed surfaces forming an aperture opening into the hollow interior of the side frame member; and a cap member having a first portion shaped complimentary to the aperture in the side frame member and an enlarged second portion having flanges extending outward beyond the first end portion for trapping the edge of the flexible sheet in the aperture in the side frame as the cap member is inserted over the flexible sheet into the aperture in the side frame; and a plurality of connectors joined at spaced locations to the side frame members of abutting frames to join a plurality of like frames with attached sheets into a complete contaminant shield of predetermined shape.

6. The contaminant shield of claim 5 wherein certain of the frames have a rectangular shape.

7. The contaminant shield of claim 5 wherein the frames are joined into a shield having a top wall and opposed, depending side walls.

8. The contaminant shield of claim 7 wherein:

the frames forming the side walls of the shield are disposed such that the flexible sheets face the flexible sheets on the opposed side wall to form a flush interior surface; and the frames forming the top wall of the shield are disposed facing outward from the shield to form a flush exterior surface.

9. The contaminant shield of claim 7 wherein:

the height of the frames forming one side wall is larger than the height of the frames forming the opposed side wall such that the top wall extends to an angle between the side walls.

10. A contaminant shield comprising:

a plurality of like frames, each frame comprising:

a plurality of side frame members joined into a frame having a predetermined shape;

a flexible sheet; and means for sealingly attaching substantially the entire edge of the flexible sheet to the periphery of the frame; the attaching means comprising:

each of the side frame members being formed with spaced side walls interconnected at one end by a central portion and inwardly and downwardly extending flanges formed at the opposite end of each side wall having spaced opposed surfaces forming an aperture opening into the hollow interior of the side frame member; and a cap member having a first portion shaped complimentary to the aperture in the side frame member and an enlarged second portion having flanges extending outward beyond the first end portion for trapping the edge of the flexible sheet in the aperture in the side frame as the cap member is inserted over the flexible sheet into the aperture in the side frame member;

clamp means disposable over the cap member and a side frame for clamping the cap member to the side frame; and means for joining a plurality of like frames with attached sheets into a complete contaminant shield of predetermined shape.

11. The contaminant shield of claim 5 further comprising a sealing strip joined to abutting side frame members and spanning substantially the entire length of the joint between the abutting side frame members.

* * * * *